US011560610B2

(12) United States Patent
Kang et al.

(10) Patent No.: US 11,560,610 B2
(45) Date of Patent: Jan. 24, 2023

(54) COPPER ALLOY FOR VALVE SEATS

(71) Applicants: HYUNDAI MOTOR COMPANY, Seoul (KR); KIA MOTORS CORPORATION, Seoul (KR)

(72) Inventors: Min Woo Kang, Incheon (KR); Soon Woo Kwon, Ansan-si (KR); Hyun Ki Kim, Suwon-si (KR); Chung An Lee, Hwaseong-si (KR); Seung Hyun Hong, Seoul (KR); Young Nam Kim, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 121 days.

(21) Appl. No.: 17/075,029

(22) Filed: Oct. 20, 2020

(65) Prior Publication Data

US 2021/0395862 A1 Dec. 23, 2021

(30) Foreign Application Priority Data

Jun. 22, 2020 (KR) ..... 10-2020-0075479

(51) Int. Cl.

| | |
|---|---|
| ***C22C 9/00*** | (2006.01) |
| ***F01L 3/02*** | (2006.01) |
| ***C22C 30/02*** | (2006.01) |

(52) U.S. Cl.

CPC ..... *C22C 9/00* (2013.01); *C22C 30/02* (2013.01); *F01L 3/02* (2013.01); *F01L 2301/00* (2020.05)

(58) Field of Classification Search

None

See application file for complete search history.

(56) References Cited

U.S. PATENT DOCUMENTS

| | | | | |
|---|---|---|---|---|
| 5,004,581 | A | 4/1991 | Takagi et al. | |
| 6,037,067 | A | 3/2000 | Fujiki et al. | |
| 7,507,305 | B2 | 3/2009 | Kawasaki et al. | |
| 7,757,396 | B2 | 7/2010 | Sawada et al. | |
| 10,961,607 | B2 | 3/2021 | Oshima et al. | |
| 2004/0045641 | A1* | 3/2004 | Kawasaki | C22C 1/0425 148/435 |
| 2007/0125458 | A1 | 6/2007 | Kawasaki et al. | |
| 2018/0272471 | A1 | 9/2018 | Aoyama et al. | |
| 2018/0272472 | A1 | 9/2018 | Aoyama et al. | |
| 2019/0136346 | A1 | 5/2019 | Oshima et al. | |

FOREIGN PATENT DOCUMENTS

| | | | |
|---|---|---|---|
| EP | 0411882 | A1 | 2/1991 |
| EP | 1694876 | B1 | 1/2008 |
| JP | H0647187 | B2 | 6/1994 |
| JP | 2748717 | B2 | 5/1998 |
| JP | H10339117 | A | 12/1998 |
| JP | 2018158379 | A | 10/2018 |
| JP | 2019085626 | A | 6/2019 |

* cited by examiner

*Primary Examiner* — Brian D Walck

(74) *Attorney, Agent, or Firm* — Lempia Summerfield Katz LLC

(57) ABSTRACT

A copper alloy for valve seats, and more particularly a copper alloy for valve seats with improved wear resistance, contains 12 to 24% by weight of Ni, 2 to 4% by weight of Si, 7 to 13% by weight of Cr, 20 to 35% by weight of Fe, and a balance of Cu and other impurities.

5 Claims, 15 Drawing Sheets

FIG. 4

| Item | Ni | Si | Cr | Fe | Cu | Cracking | HAZ thickness (㎜) | Wear amount (㎛2) | Area of Fe matrix (%) | Note |
|---|---|---|---|---|---|---|---|---|---|---|
| Example 1 | 17 | 3 | 10 | 20 | Bal. | Non-cracking | 0.7 | 11,400 | 24 | - |
| Example 2 | 17 | 3 | 10 | 30 | Bal. | Non-cracking | 0.8 | 10,600 | 34 | - |
| Example 3 | 17 | 3 | 10 | 35 | Bal. | Non-cracking | 0.9 | 11,600 | 39 | - |
| Example 4 | 17 | 3 | 7 | 20 | Bal. | Non-cracking | 0.7 | 12,000 | 25 | - |
| Example 5 | 17 | 3 | 7 | 30 | Bal. | Non-cracking | 0.8 | 11,300 | 35 | - |
| Example 6 | 17 | 3 | 7 | 35 | Bal. | Non-cracking | 0.9 | 12,200 | 40 | - |
| Example 7 | 17 | 3 | 13 | 20 | Bal. | Non-cracking | 0.7 | 13,000 | 20 | - |
| Example 8 | 17 | 3 | 13 | 30 | Bal. | Non-cracking | 0.8 | 11,500 | 33 | - |
| Example 9 | 17 | 3 | 13 | 35 | Bal. | Non-cracking | 0.9 | 11,900 | 38 | - |
| Comparative Example 1 | 17 | 3 | 7 | 15 | Bal. | Non-cracking | 0.6 | 27,400 | 10 | - |
| Comparative Example 2 | 17 | 3 | 10 | 15 | Bal. | Non-cracking | 0.6 | 28,900 | 12 | - |
| Comparative Example 3 | 17 | 3 | 13 | 15 | Bal. | Non-cracking | 0.7 | 31,700 | 14 | - |
| Comparative Example 4 | 17 | 3 | 7 | 10 | Bal. | Non-cracking | 0.5 | 36,100 | - | Absence of Fe matrix |
| Comparative Example 5 | 17 | 3 | 10 | 10 | Bal. | Non-cracking | 0.6 | 33,100 | - | Absence of Fe matrix |
| Comparative Example 6 | 17 | 3 | 13 | 10 | Bal. | Non-cracking | 0.6 | 31,200 | - | Absence of Fe matrix |
| Comparative Example 7 | 17 | 3 | 7 | 40 | Bal. | Cracking | 1.1 | 0 | 50 | - |
| Comparative Example 8 | 17 | 3 | 10 | 40 | Bal. | Cracking | 1.2 | 0 | 48 | - |
| Comparative Example 9 | 17 | 3 | 13 | 40 | Bal. | Cracking | 1.2 | 0 | 45 | - |
| Comparative Example 10 | 17 | 3 | 15 | 20 | Bal. | Non-cracking | 0.8 | 44,800 | 14 | Presence of BCC Cr phase |
| Comparative Example 11 | 17 | 3 | 15 | 30 | Bal. | Non-cracking | 0.9 | 45,800 | 24 | Presence of BCC Cr phase |
| Comparative Example 12 | 17 | 3 | 15 | 35 | Bal. | Non-cracking | 0.9 | 47,300 | 28 | Presence of BCC Cr phase |
| Comparative Example 13 | 17 | 3 | 5 | 20 | Bal. | Deep cracking | 0.7 | 53,500 | 20 | Acicular/ network Fe matrix |
| Comparative Example 14 | 17 | 3 | 5 | 30 | Bal. | Deep cracking | 0.7 | 53,200 | 29 | Acicular/ network Fe matrix |
| Comparative Example 15 | 17 | 3 | 5 | 35 | Bal. | Deep cracking | 0.8 | 55,900 | 34 | Acicular/ network Fe matrix |
| Comparative Example 16 | 17 | 3 | - | 30 | Bal. | Deep cracking | 0.9 | 56,300 | 31 | Acicular/ network Fe matrix |

FIG. 6

| No | Fe (wt%) | Cr(wt%) | 1.27[Fe]-0.36[Cr] | Determination | Fe Area of Fe matrix (%) |
|---|---|---|---|---|---|
| 1 | 20 | 10 | 21.8 | pass | 24 |
| 2 | 30 | 10 | 34.5 | pass | 34 |
| 3 | 35 | 10 | 40.85 | pass | 39 |
| 4 | 20 | 7 | 22.88 | pass | 25 |
| 5 | 30 | 7 | 35.58 | pass | 35 |
| 6 | 35 | 7 | 41.93 | pass | 40 |
| 7 | 20 | 13 | 20.72 | pass | 20 |
| 8 | 30 | 13 | 33.42 | pass | 33 |
| 9 | 35 | 13 | 39.77 | pass | 38 |
| 10 | 15 | 7 | 16.53 | fail | 10 |
| 11 | 15 | 10 | 15.45 | fail | 12 |
| 12 | 15 | 13 | 14.37 | fail | 14 |
| 13 | 10 | 7 | 10.18 | fail | 0 |
| 14 | 10 | 10 | 9.1 | fail | 0 |
| 15 | 10 | 13 | 8.02 | fail | 0 |
| 16 | 40 | 7 | 48.28 | fail | 50 |
| 17 | 40 | 10 | 47.2 | fail | 48 |
| 18 | 40 | 13 | 46.12 | fail | 45 |
| 19 | 20 | 15 | 20 | fail | 14 |

COPPER ALLOY FOR VALVE SEATS

CROSS-REFERENCE TO RELATED APPLICATION

This application claims priority to and the benefit of Korean Patent Application No. 10-2020-0075479, filed on Jun. 22, 2020 in the Korean Intellectual Property Office, the disclosure of which is incorporated herein by reference.

BACKGROUND

1. Field of the Disclosure

The present disclosure relates to a copper alloy for valve seats, and more particularly to a copper alloy for valve seats with improved wear resistance.

2. Description of the Related Art

A cylinder head of an engine is provided with an engine valve such as an intake valve or an exhaust valve. Combustion explosion heat and mechanical shock generated while the engine operates are transferred from the engine valve to the cylinder head. However, a general cylinder head is made of an aluminum (Al) material, thus having a problem of being damaged by high temperatures and impacts.

For this reason, in the conventional process of manufacturing a cylinder head, a valve seat made of an Fe-based powder sintered material is typically installed in the area that comes into contact with the engine valve.

However, the valve seat made of the Fe-based powder sintered material must be installed on the cylinder head through mechanical coupling. This causes a problem of requiring a separate fastening means and the disadvantage of the impossibility of realizing linear flow passages due to the need to form the valve seat to a certain thickness or more. In addition, a problem in which the valve seat is disengaged during engine operation occurs.

Meanwhile, the valve seat requires excellent heat resistance and wear resistance since it is required to withstand conditions including contact and friction with the engine valve as well as exposure to the exhaust gas.

Accordingly, recently, in the process of manufacturing a cylinder head, the corresponding region has been reinforced by directly cladding a cladding layer on a region that comes into contact with the engine valve through a laser-cladding method using a Cu-based material having excellent heat resistance and wear resistance.

However, the cladding layer formed by the laser-cladding method using a Cu-based material has a disadvantage of exhibiting significantly lower wear resistance than a valve seat made of an Fe-based powder material.

Accordingly, in order to overcome the problems with the Cu-based material, a method of forming a valve seat by a laser-cladding method using an Fe-based material may be considered. However, in this case, the Fe-based material, which has a melting point of about 1,400° C. or higher, requires greater heat input than that of a Cu-based material, which has a lower melting point of about 1,000° C. Thus, the greater heat input may cause greater thermal damage to the cylinder head made of aluminum (Al). This results in interfacial cracks and thermal cracks in the cladding regions due to the widened heat-affected zone, thus disadvantageously making it difficult to form an intact valve-seat-shaped cladding layer without leakage.

The above information disclosed in this Background section is provided only for enhancement of understanding of the background of the disclosure and therefore it may contain information that does not form the prior art that is already known to a person of ordinary skill in the art.

SUMMARY

Therefore, the present disclosure has been made in view of the above problems, and it is one object of the present disclosure to provide a copper alloy for valve seats that may improve wear resistance by forming a dual-phase cladding layer in which a Cu matrix structure and an Fe matrix structure are formed together.

In accordance with the present disclosure, the above and other objects may be accomplished by the provision of a copper alloy for valve seats containing 12 to 24% by weight of Ni, 2 to 4% by weight of Si, 7 to 13% by weight of Cr, 20 to 35% by weight of Fe, and a balance of Cu and other impurities.

A matrix structure of the copper alloy may be a dual-phase matrix structure including a Cu matrix structure and an Fe matrix structure formed together.

The copper alloy may form a (Ni,Cr)Si-based hard phase in the matrix structure.

An area fraction of the Fe matrix structure in the copper alloy may be 20 to 40% of a total area.

The copper alloy may satisfy the following Relational Formula 1:

$$20.7<1.27[Fe]-0.36[Cr]<42.0 \quad \text{(Relational Formula 1)}$$

wherein [Fe] and [Cr] represent contents (wt %) of Fe and Cr.

The copper alloy may not form a Cr phase of a body-centered cubic structure (BCC).

An amount of wear of the copper alloy, measured in a high-temperature frictional wear test under the following conditions, may be less than 20,000 $um^2$:

(Conditions for high-temperature friction wear test)
Pin material: Inconel
Load: 50 N
Temperature: 200° C.
Stroke: 7 mm
Frequency: 6 Hz
Atmosphere: Air
Time: 10 minutes The copper alloy may have a thickness of a heat-affected zone of 1 mm or less after laser cladding.

BRIEF DESCRIPTION OF THE DRAWINGS

The above and other objects, features and other advantages of the present disclosure should be more clearly understood from the following detailed description taken in conjunction with the accompanying drawings, in which:

FIG. 4 is a table showing the components and experimental results of Comparative Examples and Examples;

FIG. 6 is a table showing the relationship between the area fraction of the Fe matrix structure and Relational Formula 1 according to changes in the contents of Fe and Cr.

DETAILED DESCRIPTION OF THE EMBODIMENTS

Figure 1:
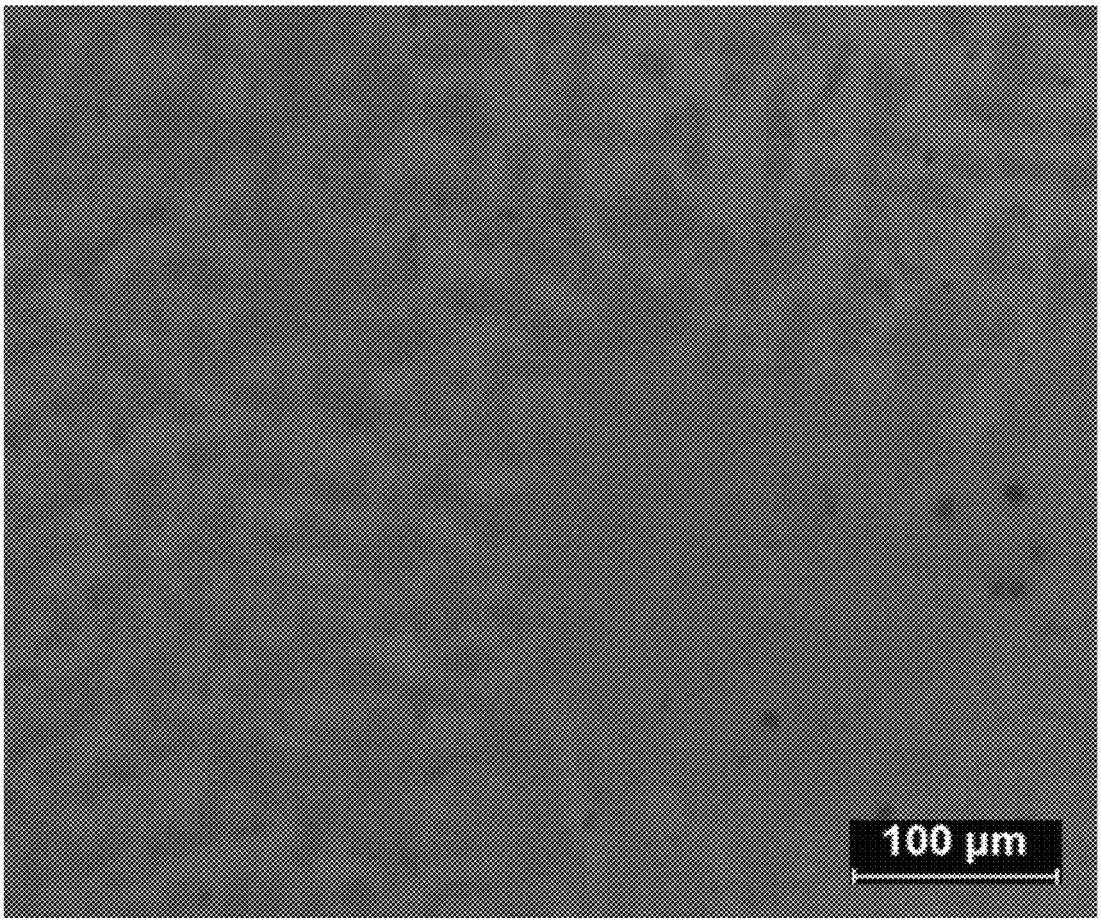
FIG. 1 is a microstructure image of a cladding layer produced using a Cu-17Ni-3Si-30Fe material.
Figure 2A:
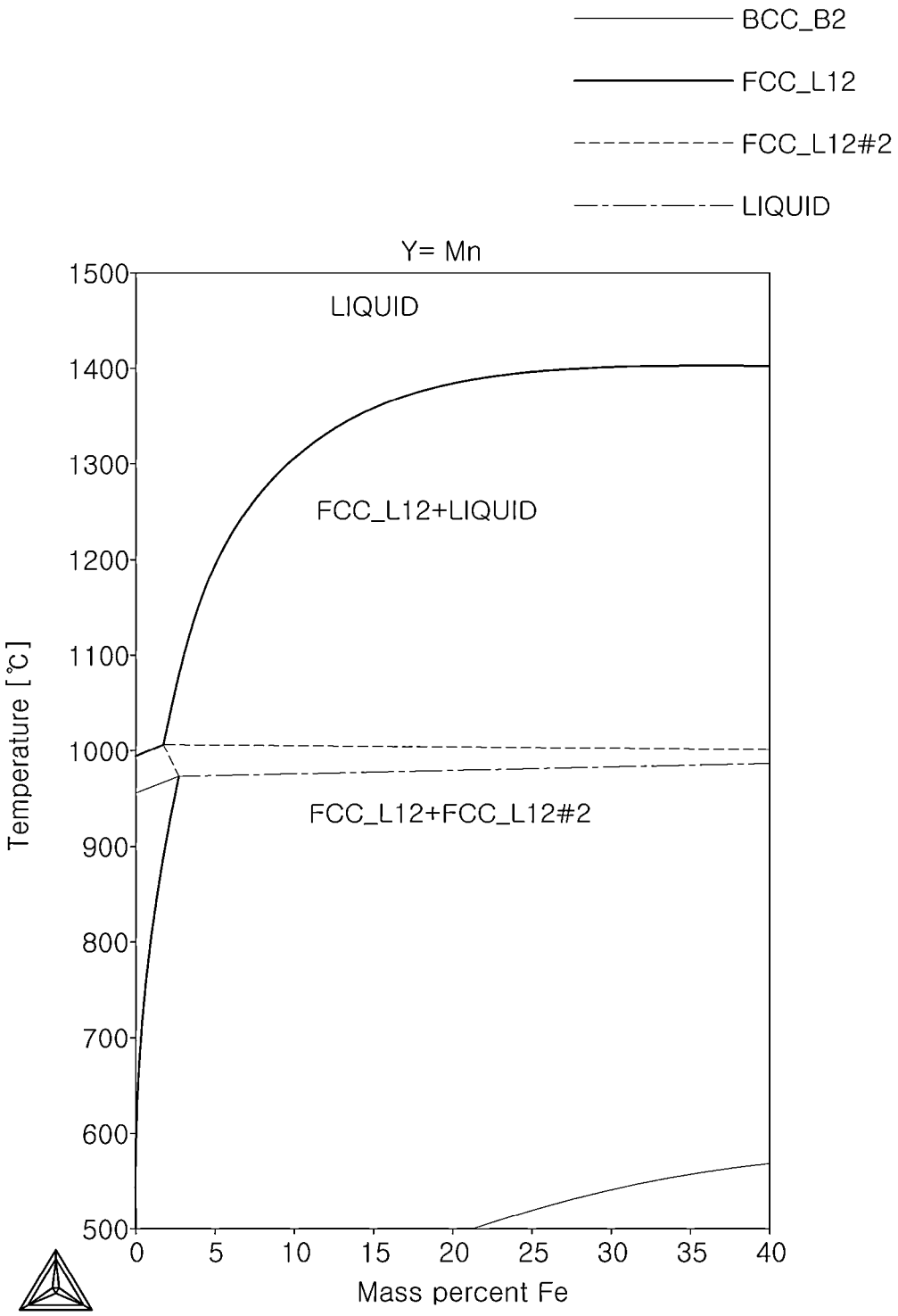
FIGS. 2A-2I are graphs showing the results of calculation of the phase diagram for each content of Fe depending on added alloying element.
Figure 2B:
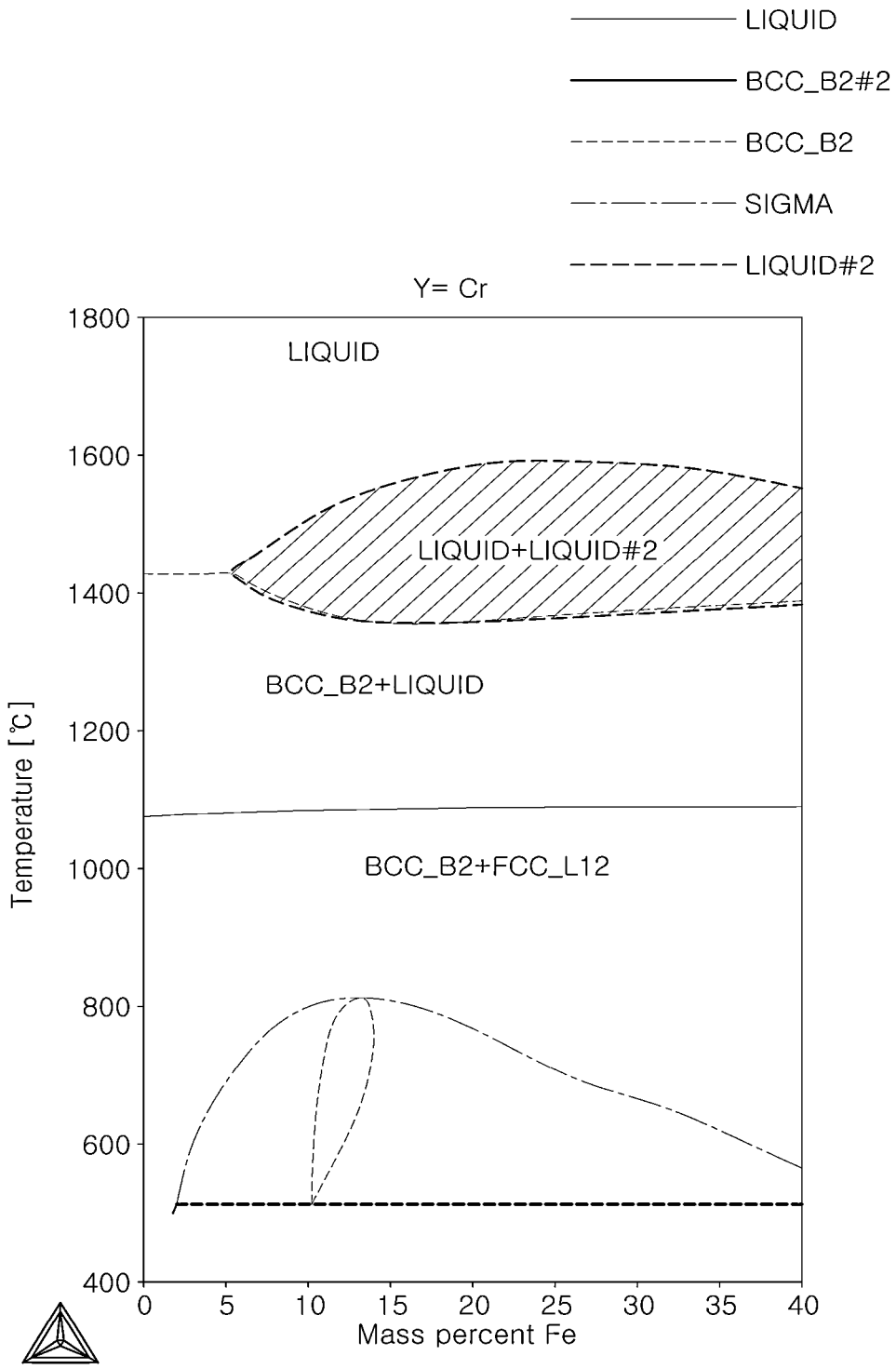
Figure 2C:
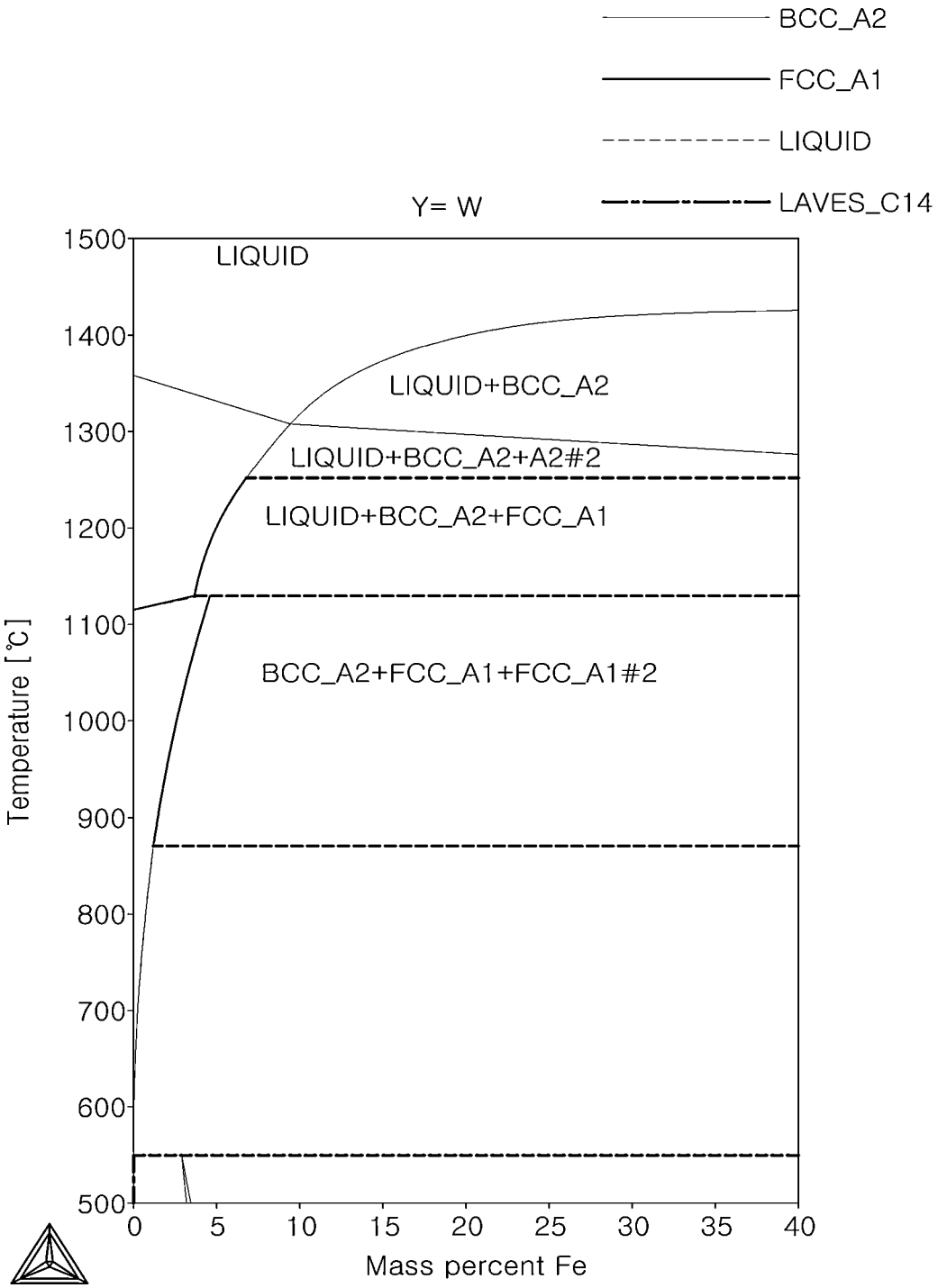
Figure 2D:
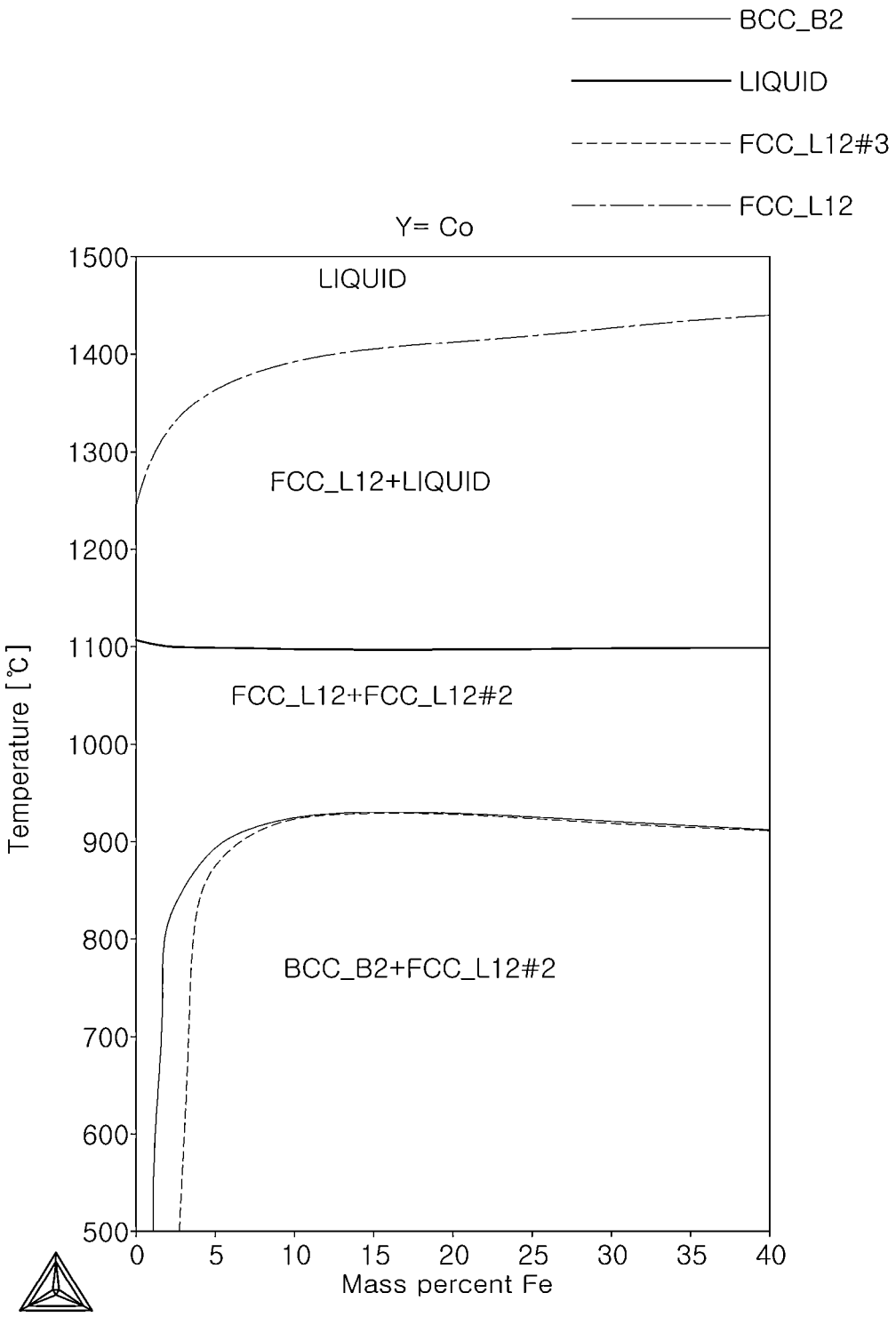
Figure 2E:
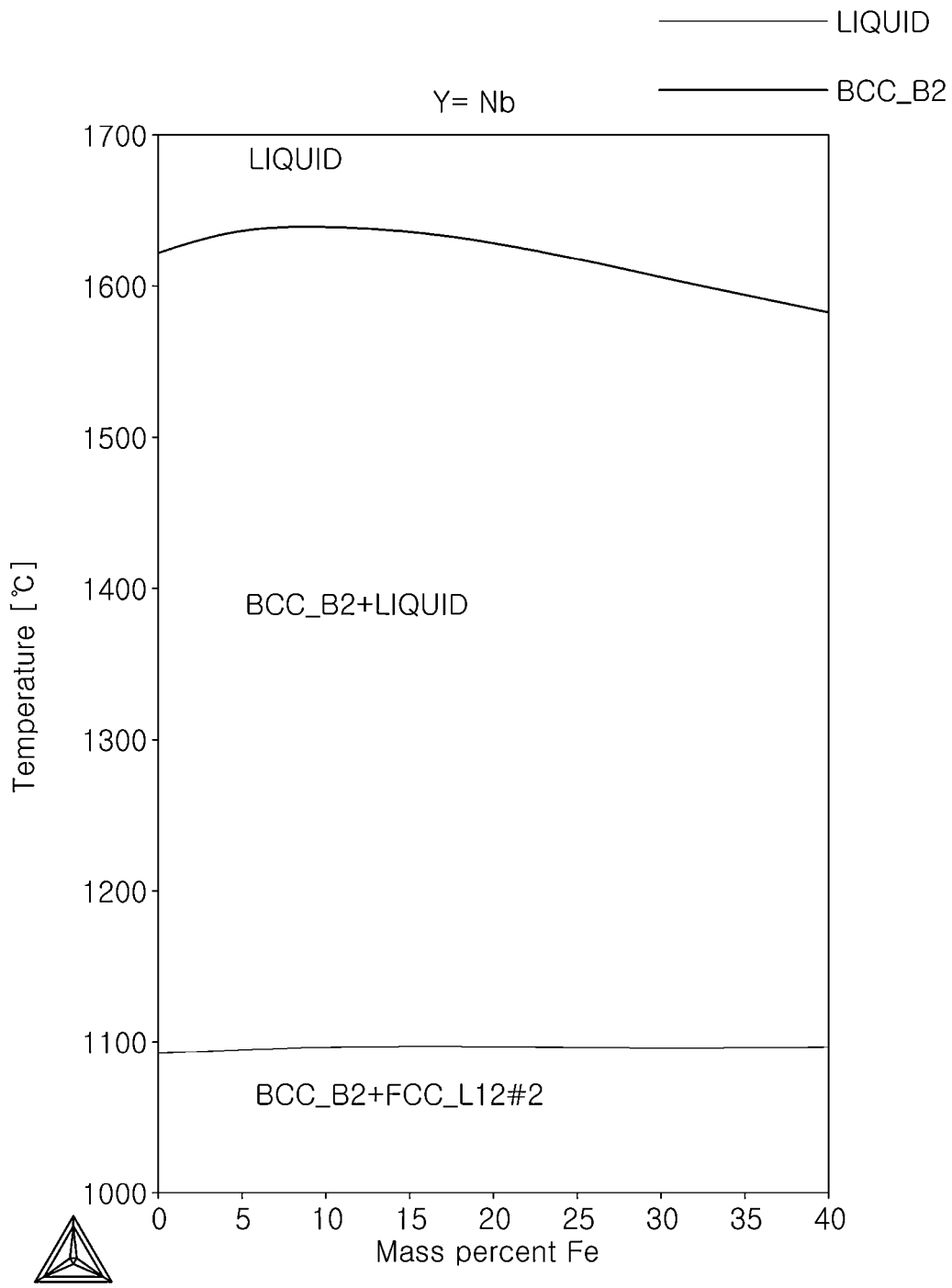
Figure 2F:
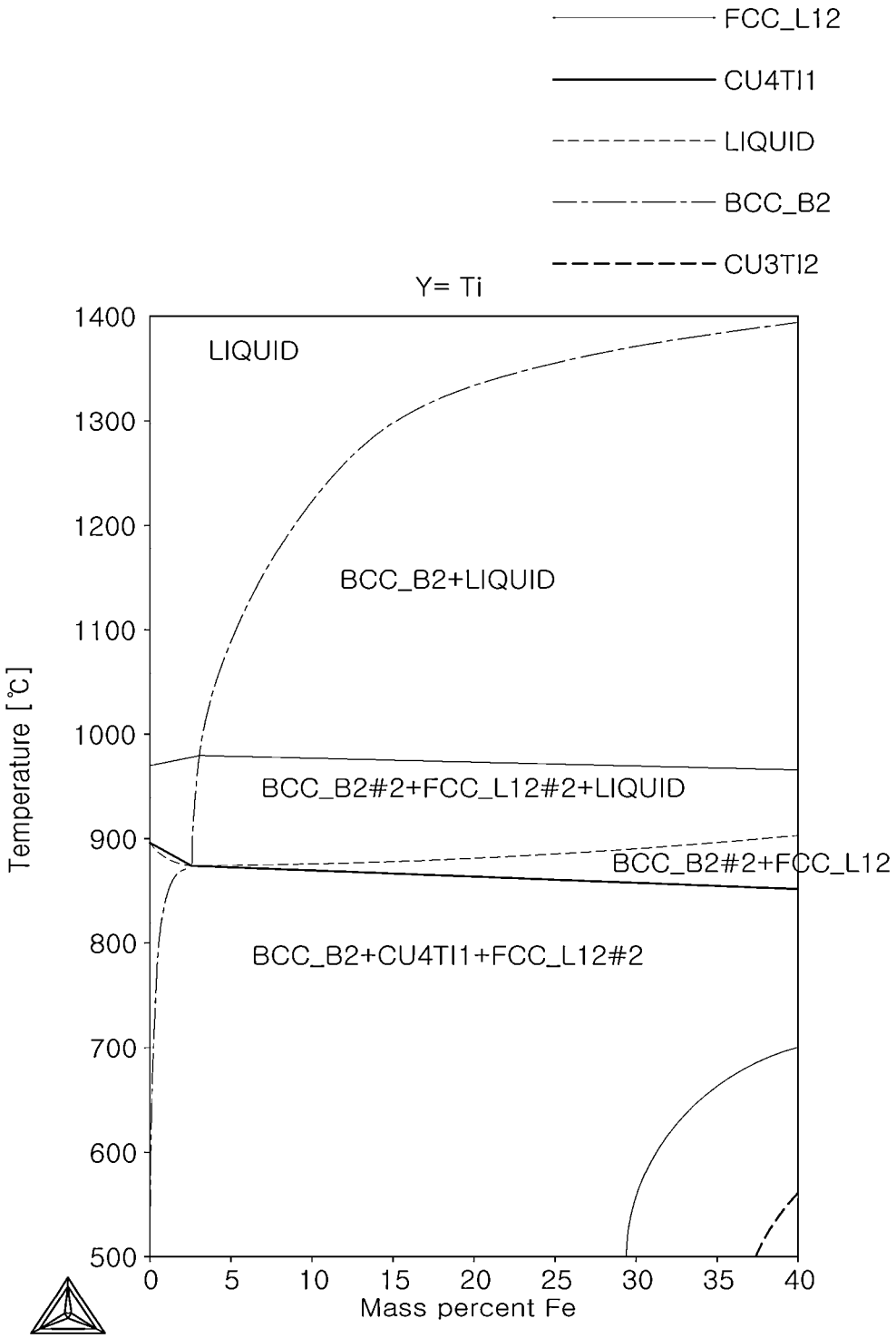
Figure 2G:
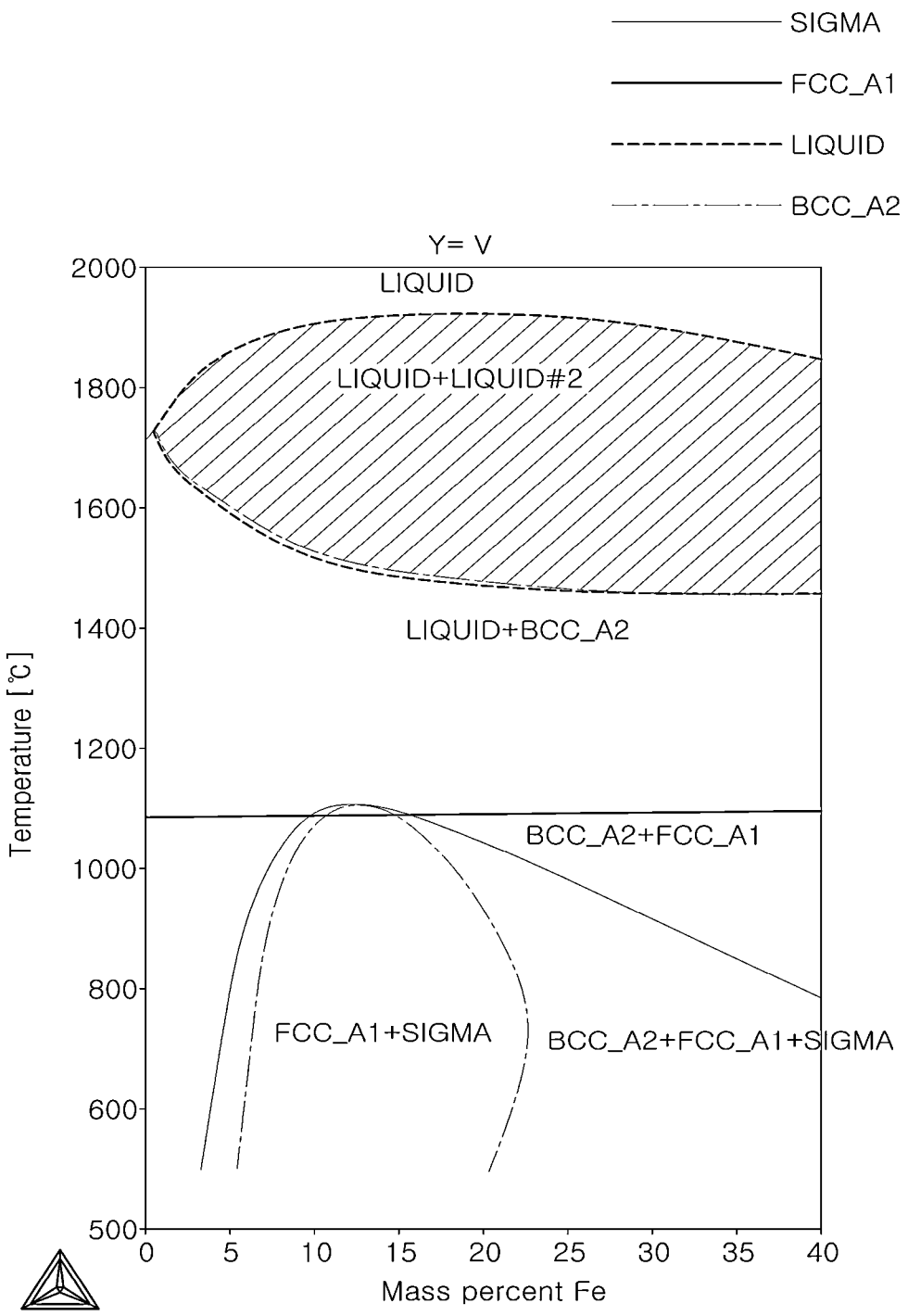
Figure 2H:
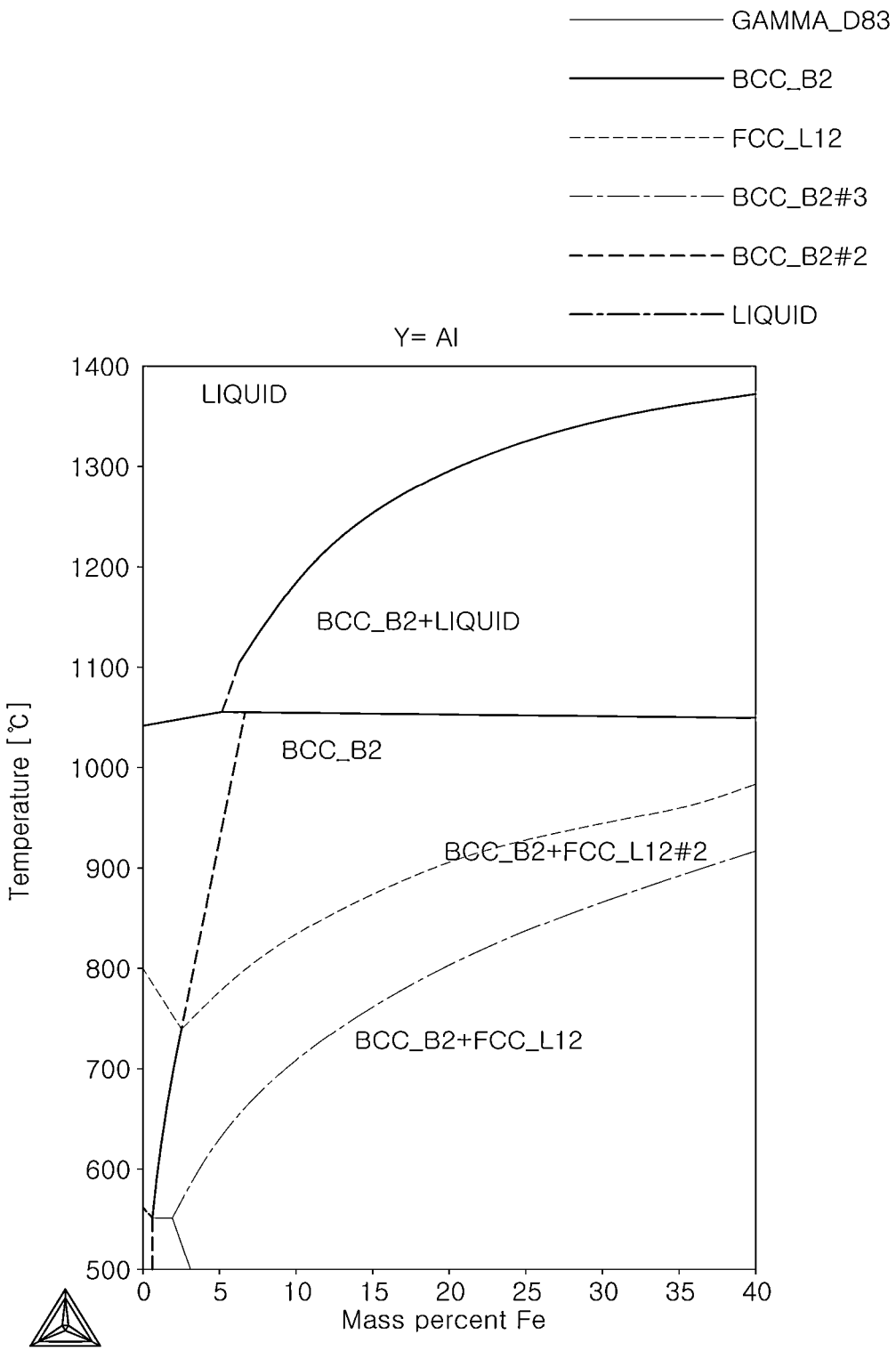
Figure 2I:
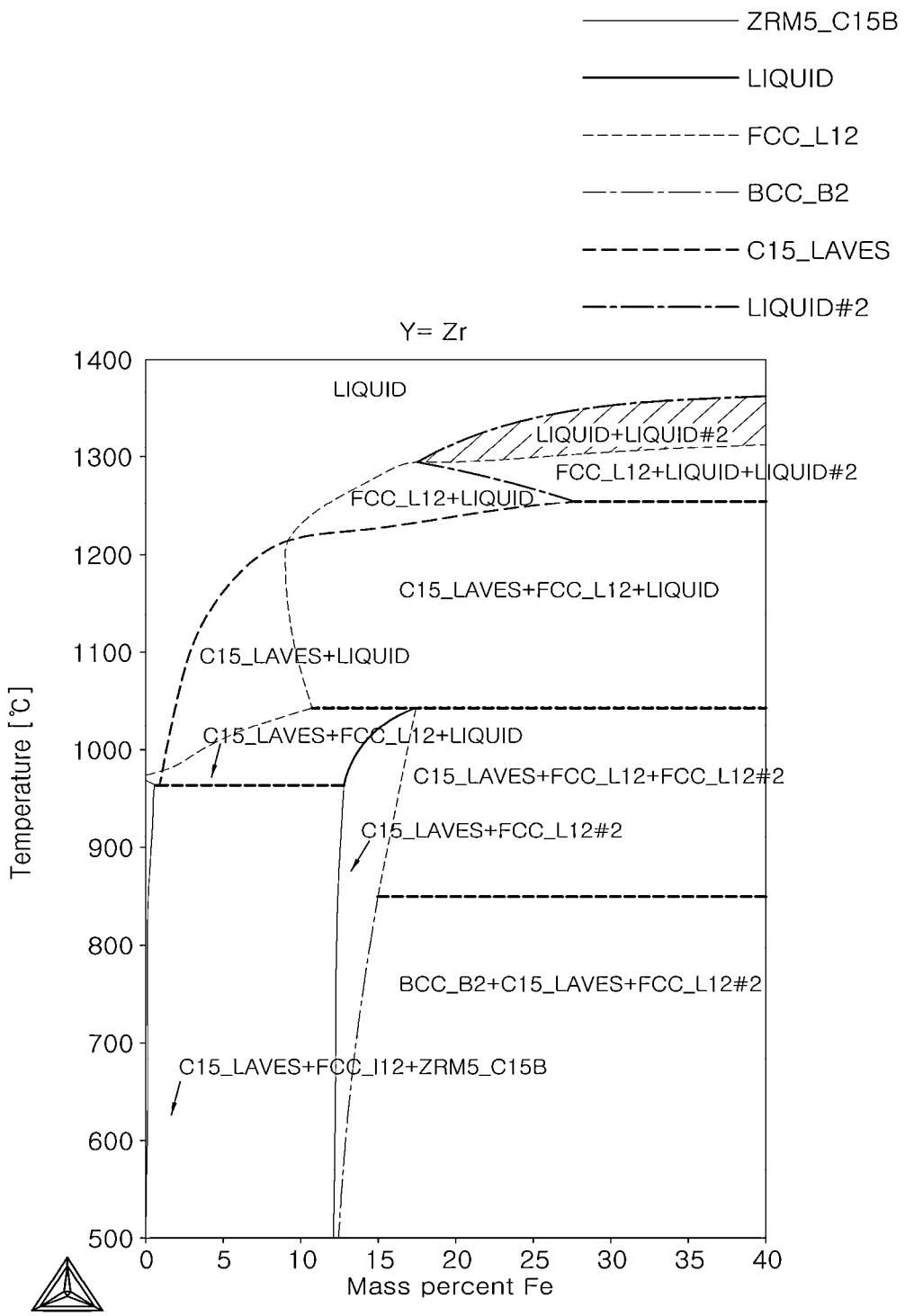

Reference will now be made in detail to embodiments of the present disclosure, examples of which are illustrated in the accompanying drawings. However, the present disclosure is not limited to the embodiments, and may be implemented in various forms. The embodiments are provided only to fully illustrate the present disclosure and to completely inform those having ordinary knowledge in the art of the scope of the present disclosure.

The copper alloy for valve seats according to an embodiment of the present disclosure is an alloy that may be used for laser cladding. For example, a cladding layer having improved heat resistance and wear resistance may be formed in regions where an engine valve contacts an engine cylinder head. This cladding layer serves as a conventional valve seat that is fastened to the cylinder head. Hereinafter, the layer formed by a laser-cladding method using the copper alloy for valve seats according to an embodiment of the present disclosure has been referred to as a "cladding layer".

In this embodiment, in order to improve the heat resistance and wear resistance of the cladding layer made of a copper alloy, the type and components of the alloy were adjusted to form a (Ni,Cr)Si-based hard phase in the matrix structure, while forming a dual-phase matrix structure in which a Cu matrix structure and an Fe matrix structure are formed together. In addition, by adjusting the type and components of the alloy, the formation of the Cr phase of the body-centered cubic structure (BCC) was prevented while the area ratio of the Fe matrix structure was controlled.

In particular, by adjusting the type and components of the alloy, liquid immiscibility was induced so as to form the Fe matrix structure as a roundish structure rather than an acicular or network structure.

Specifically, the copper alloy for valve seats according to an embodiment of the present disclosure contains 12 to 24% by weight of Ni, 2 to 4% by weight of Si, 7 to 13% by weight of Cr, 20 to 35% by weight of Fe, and a balance of Cu and other impurities.

Next, the reason for limiting the alloy ingredients and the content ranges thereof is described below. Hereinafter, unless stated otherwise, percentage (%) means percentage (%) by weight, which is a unit of a content range.

In some cases, nickel (Ni) is or may be present in an amount of 12 to 24%. Nickel (Ni) forms a Cu—Ni—Si-based solid structure and forms a strengthening phase that may be expressed as $Ni_xSi_y$, such as NiSi, $NiSi_2$, $Ni_2Si$, $Ni_3Si$, $Ni_31Si_{12}$, $Ni_3Si_2$ and $Ni_5Si_2$, to improve the strength of a cladding layer made of an alloy. Thus, maintaining the content of nickel (Ni) at 12% or more may maintain the excellent strength and wear resistance of the cladding layer. However, when the content of nickel (Ni) exceeds 24%, a problem may occur in that the interfacial bonding property between the cladding layer and the cylinder head, which is the base material, may be reduced.

In some cases, silicon (Si) is or may be present in an amount of 2 to 4%. Silicon (Si) forms a Cu—Ni—Si-based solid structure and forms a strengthening phase that may be expressed as $Ni_xSi_y$, such as NiSi, $NiSi_2$, $Ni_2Si$, $Ni_3Si$, $Ni_31Si_{12}$, $Ni_3Si_2$ and $Ni_5Si_2$, while improving the interfacial bonding property between the cladding layer and the cylinder head, which is the base material. Thus, maintaining the content of silicon (Si) at 2% or more may form an appropriate strengthening phase while improving the interfacial bonding property between the cladding layer and the cylinder head. However, when the content of silicon (Si) exceeds 4%, an increase in the fraction of the Cu—Ni—Si solid structure may decrease the ductility of the cladding layer, resulting in a problem of cracking.

In some cases, chromium (Cr) is or may be present in an amount of 7 to 13%. Chromium (Cr) is an element that induces liquid immiscibility, and inhibits the formation of an acicular or network structure. Thus, when the content of chromium (Cr) is less than 7%, liquid immiscibility is or may not be obtained upon solidification, resulting in the formation of acicular and network structures and thus a problem of deterioration in crack resistance. In addition, when the content of chromium (Cr) exceeds 13%, a Cr phase of the body-centered cubic structure (BCC) is or may be formed, thus disadvantageously causing brittleness.

In some cases, iron (Fe) is or may be present in an amount of 20 to 35%. Iron (Fe) is an element that forms a hard Fe matrix structure and improves wear resistance. Therefore, when the content of iron (Fe) is less than 20%, a problem occurs in that wear resistance cannot or may not be maintained at a desired level due to the reduced fraction of the Fe matrix structure. When the content of iron (Fe) exceeds 35%, problems may occur in that the cladding layer may crack and the thickness of the heat-affected zone is or may be greater than 1 mm.

Meanwhile, the balance, other than the above-mentioned components, includes copper (Cu) and impurities.

Particularly, in this embodiment, the copper alloy limits the relative content of iron (Fe) and chromium (Cr) in order to adjust the area fraction of the Fe matrix structure to 20 to 40% of the total area. Specifically, the relative content between iron (Fe) and chromium (Cr) satisfies the following Relational Formula 1:

$$20.7<1.27[Fe]-0.36[Cr]<42.0 \quad \text{(Relational Formula 1)}$$

wherein [Fe] and [Cr] represent the contents (wt %) of Fe and Cr.

Hereinafter, the present disclosure is described with reference to Comparative Examples and Examples below.

The cladding layer formed by a laser-cladding method using a Cu—Ni—Si-based material, which is an alloy material commonly used for the laser-cladding method, has or may have a disadvantage of significantly lower wear resistance than that of a conventional valve seat made of an Fe-based powder material.

So, first, in order to improve the wear resistance of the Cu—Ni—Si-based material, an experiment to form an Fe matrix structure together with a Cu matrix structure by adding Fe to the Cu—Ni—Si-based material was conducted.

More specifically, a cladding layer was formed on an aluminum base material (Al) by a laser-cladding method using a Cu-17Ni-3Si-30Fe material, the microstructure of the cladding layer was observed, and the results are shown in FIG. 1. Here, the Cu-17Ni-3Si-30Fe material means a copper alloy material that includes 17 wt % of Ni, 3 wt % of Si, 30 wt % of Fe, and the balance of Cu and other impurities.

As may be seen from FIG. 1, when only Fe was added to the component system of Cu-17Ni-3Si, a dual-phase matrix structure including both a Cu matrix structure and an Fe matrix structure formed as the matrix structure was formed, but the Fe matrix structure was formed as acicular and network structures. In FIG. 1, a relatively dark structure represents the Fe matrix structure and a relatively light structure represents the Cu matrix structure.

The reason for forming the Fe matrix structure as acicular and network structures is that liquid immiscibility is not or may not be obtained and even though the Fe matrix structure is formed, it is not or may not be randomly distributed, but takes the form of acicular and network structures.

When the Fe matrix structure has acicular and network structures as shown in FIG. 1, the wear resistance of the cladding layer may be significantly reduced because the size of the interface between the matrixes is increased and the interface provides a fracture path.

Next, in order to induce liquid immiscibility, an experiment was performed to form an Fe matrix structure together with a Cu matrix structure using a Cu-17Ni-3Si-aFe-20Y material, wherein a represents the content of Fe (wt %) and Y is an alloy element added along with Fe. In this experiment, an alloy element of any one of Mn, Cr, W, Co, Nb, Ti, V, Al and Zr was selectively added as Y. Accordingly, the results of calculation of the phase diagram of the Fe content for each material were determined, and the results are shown in FIGS. 2A-2I. In FIGS. 2A-2I, regions expressed in dark colors are liquid immiscible (separation) regions.

As may be seen from the results of FIGS. 2A-2I, liquid immiscibility occurred when Cr, V and Zr were added, and liquid immiscibility did not occur when Mn, W, Co, Nb, Ti, and Al were added. This result is or may be obtained because the liquid immiscibility between the Cu-based component and the Fe-based component is or may be obtained as the solubility of Fe in a liquid state to Cu decreases due to the addition of Cr, V, and Zr.

Accordingly, it was confirmed that, when Cr, V, and Zr were added, an Fe matrix structure took a roundish structure, rather than an acicular or network structure, and a dual-phase structure in which a Cu matrix structure and the Fe matrix structure are formed together was obtained.

However, among the added components, V is a relatively expensive alloying element and Zr has a small liquid-immiscible region and thus does not effectively induce a change in structure. Thus, it may be seen that liquid immiscibility between the Fe- and Cr-based matrix structures may be induced by adding Fe and Cr to the Cu—Ni—Si-based material.

Next, in order to determine the appropriate content of Cr, an experiment was performed to confirm the change in the state of the alloy using a Cu-17Ni-3Si-25Fe-bCr material, wherein b represents the content (wt %) of Cr. Thus, the result of calculation of the phase diagram depending on Cr content was obtained and the result is shown in FIG. 3.

Figure 3:
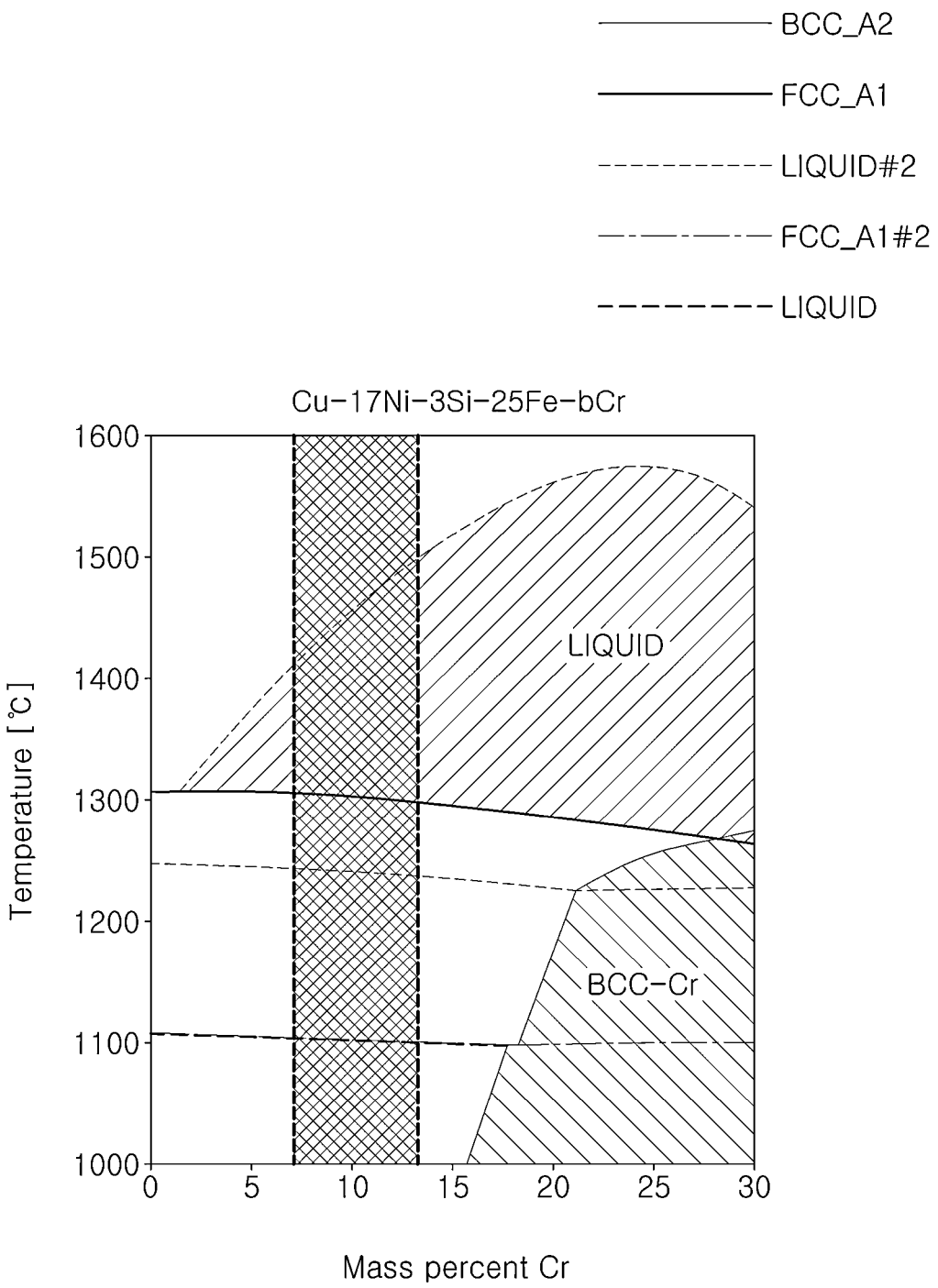
FIG. 3 is a graph showing the result of calculation of the phase diagram for each content of Cr.

As may be seen from the result of FIG. 3, in the region where the content of Cr is 5 wt %, in some cases less than 7 wt %, the temperature region where liquid immiscibility occurs is or may be narrow, so it may be difficult to avoid formation of acicular and network structures. In addition, in the region where the content of Cr is 15 wt %, in some cases more than 13 wt %, a Cr phase of the body-centered cubic structure (BCC) is or may be formed, which may cause a problem of poor impact toughness. Accordingly, the content of Cr is or may be, in some cases, 7 to 13 wt %.

Figure 5A:
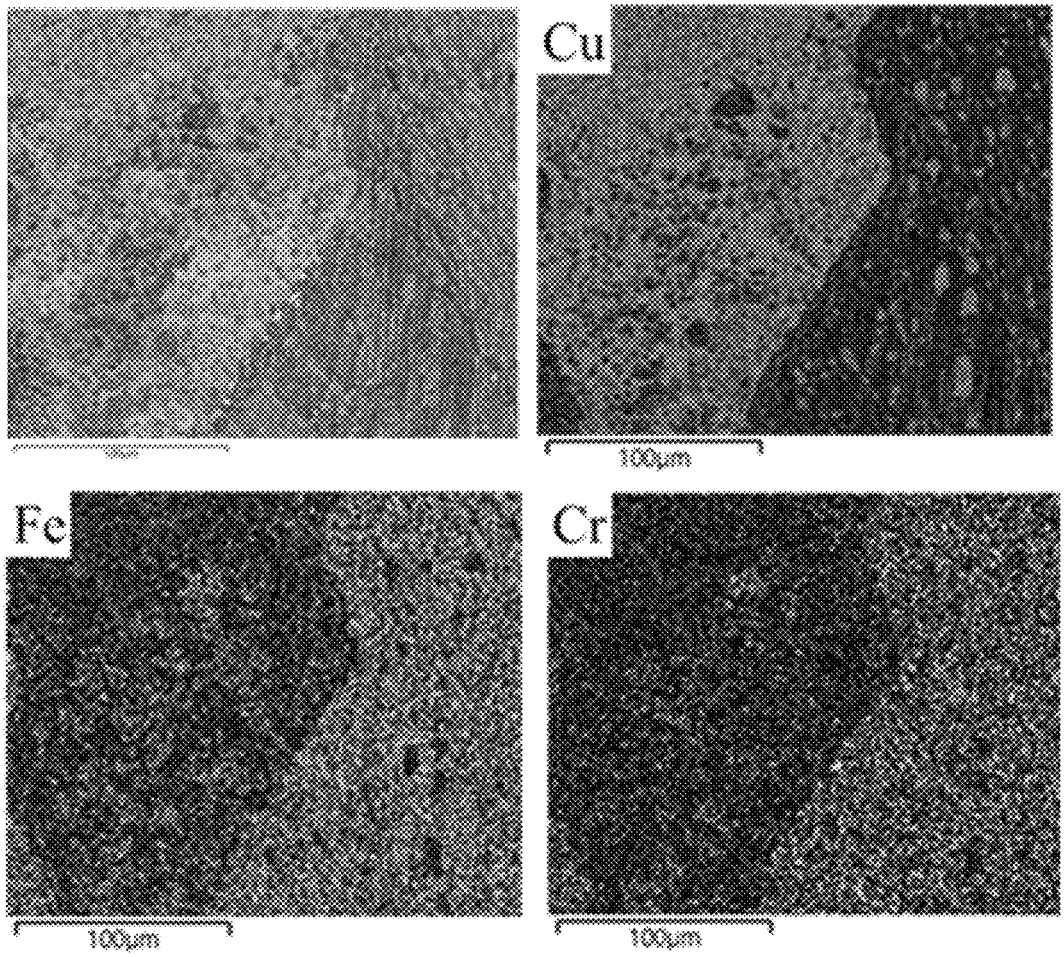
FIGS. 5A and 5B are microstructure images of Example 2 and Comparative Example 17.
Figure 5B:
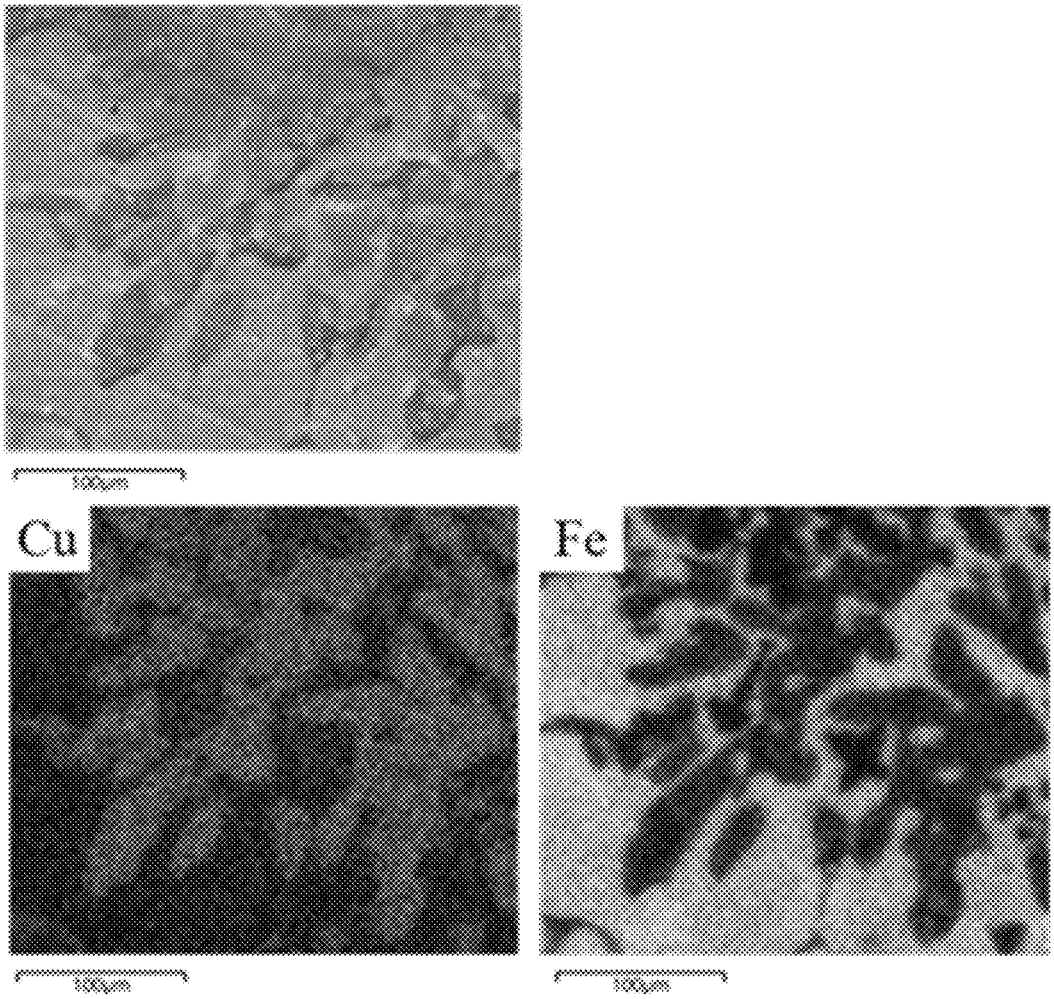

Next, in order to determine appropriate contents of Fe and Cr in the Cu—Ni—Si-based material, a cladding layer was formed on an aluminum (Al) base material through a laser-cladding method using a copper alloy having adjusted contents of the components as shown in FIG. 4. The occurrence of cracks in the clad layer, the thickness of the heat-affected zone, and the amount of wear and microstructures were measured and observed, and the results are shown in FIG. 4 together. In addition, the microstructures of Example 2 and Comparative Example 16 of FIG. 4 are shown in FIGS. 5A and 5B, respectively.

At this time, the evaluation of whether cracks occurred was conducted using a dye penetrant inspection method (ISO 3452-1, Non-destructive testing. Penetrant testing).

More particularly, the dye penetration inspection (DPI) is a method utilizing a capillary phenomenon. First, a specimen is washed with a washing solution, a penetrant solution is sprayed on an area to be inspected and dried for 5 minutes, and the penetrant solution on the surface of the specimen is removed with the washing solution. Then, a developing solution is sprayed onto the surface of the specimen to determine whether or not there are any areas where the colored penetrant solution remains. Since the penetrant solution remains in cracks, a region where the colored penetrant solution exists is determined to correspond to a crack.

In addition, the amount of wear was measured through a high-temperature frictional wear test, and the conditions of the test were as follows.

(Conditions for high-temperature friction wear test)
Pin material: Inconel
Load: 50 N
Temperature: 200° C.
Stroke: 7 mm
Frequency: 6 Hz
Atmosphere: Air
Time: 10 minutes As may be seen from FIGS. 4, 5A and 5B, all of Examples 1 to 8, as examples that satisfy the alloy components and contents thereof suggested in the present disclosure, avoided cracking and satisfied the requirements for thickness of the heat-affected zone (1 mm or less), abrasion amount (less than 20,000 $\mu m^2$), and area ratio (20-40%) of the Fe matrix structure proposed in the present disclosure.

Moreover, as may be seen from FIG. 5A, the microstructure image of Example 2 showed a dual-phase structure in which the Cu matrix structure and the Fe matrix structure were formed together as the matrix structure, particularly, showed that each microstructure was roundish.

In addition, Comparative Examples 1 to 6, as comparative examples in which the content of Fe was less than the content suggested in the present disclosure, avoided cracking and had a small thickness of the heat-affected zone. However, it was confirmed that the amount of wear was significantly increased because the Fe matrix structure was not formed, or was insufficiently formed.

Moreover, Comparative Examples 7 to 9 are comparative examples in which the content of Fe exceeded the content suggested in the present disclosure. Because the Fe matrix structure was formed excessively, cracks formed and the thickness of the heat-affected zone was also increased. At this time, the amount of wear could not be measured.

Particularly, the reason for cracking is as follows. As the heat input increases, an intermetallic compound layer such as $AlCu_2$ is or may be formed at the interface of the cladding layer formed using an aluminum-based material (Al) and an alloy, and the thickness thereof increases. The thickened intermetallic compound layer may be brittle. Therefore, cracks are formed by stress generated during solidification and contraction of the alloy forming the cladding layer. For this reason, in order to avoid cracking, the intermetallic compound layer may be formed to be thin. For this purpose, the amount of heat input may be reduced, and the content of Fe, which is a high-melting-point element, may be limited.

In addition, Comparative Examples 10 to 12, as comparative examples in which the content of Cr exceeded the content suggested in the present disclosure, avoided cracking and had a small thickness of the heat-affected zone. However, as the Cr phase of BCC was formed, the amount of wear was found to significantly increase. In addition, fitting was also generated in Comparative Examples 10 to 12.

Moreover, Comparative Examples 13 to 15 are comparative examples in which the content of Cr was less than the content suggested in the present disclosure. The thickness of the heat-affected zone was thin, and a double phase including a Cu matrix structure and an Fe matrix structure was formed together as a matrix structure. However, it was confirmed that, because an acicular or network Fe matrix structure was formed, deep cracks were formed, and the amount of wear was also significantly increased.

In addition, Comparative Example 16 is a comparative example in which Fe is added alone to the component system of Cu-17Ni-3Si. As in Comparative Examples 13 to 15, the heat-affected zone was thin and a dual phase, in which a Cu matrix structure and an Fe matrix structure were formed together, was formed as the matrix structure. However, it was confirmed that, as the acicular or network Fe matrix structure was formed, deep cracks were formed and the amount of abrasion was also significantly increased.

In addition, as may be seen from FIG. 5B, the microstructure image of Comparative Example 16 showed a dual-phase structure in which a Cu matrix structure and an Fe matrix structure were formed together as the matrix structure. However, it was confirmed that liquid immiscibility did not occur properly, so an acicular or network Fe matrix structure was formed.

Meanwhile, in the present disclosure, in order to adjust an area fraction of the Fe matrix structure to 20 to 40% of the total area, the relative content between Fe and Cr contents was limited, as shown in the following Relational Formula 1:

$$20.7<1.27[Fe]-0.36[Cr]<42.0 \quad \text{(Relational Formula 1)}$$

wherein [Fe] and [Cr] represent the contents (wt %) of Fe and Cr.

Accordingly, in order to determine the suitability of Relational Formula 1 above, alloys with Fe and Cr contents changed as shown in FIG. 6 in the component system of Cu-17Ni-3Si were formed, and 1.27 [Fe]−0.36 [Cr] value for each alloy and the area fraction of the Fe matrix structure were determined. Then, the results are shown in FIG. 6 together.

As may be seen from FIG. 6, alloys 1 to 9, which satisfy the contents of Fe and Cr suggested in the present disclosure, satisfied both Relational Formula 1 and the area fraction of the Fe matrix structure.

However, alloys 10 to 18, which satisfy the content of Fe suggested in the present disclosure, satisfied neither Relational Formula 1 nor the area fraction of the Fe matrix structure.

In addition, alloy 19, which satisfied the Cr content suggested in the present disclosure, satisfied neither Relational Formula 1 nor the area fraction of the Fe matrix structure.

As apparent from the foregoing, according to the embodiment of the present disclosure, a hard Fe matrix structure may be formed on a Cu matrix structure at an area ratio of 20 to 40%, thereby forming a cladding layer having excellent wear resistance.

As a result, the cladding layer is thin compared to a cladding layer obtained by a method including producing a valve seat separately and fastening the same to the cylinder head. Accordingly, it is possible to obtain an effect of improving intake and exhaust efficiency by achieving linear intake and exhaust passages of the engine.

As a result, it is possible to obtain an effect of improving the fuel efficiency of the engine by realizing a high tumble effect in the cylinder.

Although the embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A copper alloy for valve seats consisting of:
12 to 24% by weight of Ni;
2 to 4% by weight of Si;
7 to 13% by weight of Cr;
20 to 35% by weight of Fe; and
a balance of Cu and other impurities,
wherein the copper alloy satisfies the following Relational Formula: $20.7<1.27[Fe]-0.36[Cr]<42.0$, wherein [Fe] and [Cr] represent contents (wt. %) of Fe and Cr,
wherein an area fraction of an Fe matrix structure in the copper alloy is 20 to 40% of a total area, and
wherein a matrix structure of the copper alloy is a dual-phase matrix structure comprising a Cu matrix structure and the Fe matrix structure formed together.

2. The copper alloy for valve seats according to claim 1, wherein the copper alloy comprises a (Ni,Cr)Si-based hard phase in the matrix structure.

3. The copper alloy for valve seats according to claim 1, wherein the copper alloy does not comprise a Cr phase of a body-centered cubic structure (BCC).

4. The copper alloy for valve seats according to claim 1, wherein an amount of wear of the copper alloy, measured in a high-temperature frictional wear test under the following conditions, is less than 20,000 square micrometers ($um^2$):
(Conditions for high-temperature friction wear test)
Pin material: Inconel,
Load: 50 N,
Temperature: 200° C.,
Stroke: 7 mm,
Frequency: 6 Hz,
Atmosphere: Air, and
Time: 10 minutes.

5. The copper alloy for valve seats according to claim 1, wherein the copper alloy has a thickness of a heat-affected zone of 1 mm or less after laser cladding.

* * * * *